US009594339B2

(12) United States Patent
Park et al.

(10) Patent No.: US 9,594,339 B2
(45) Date of Patent: Mar. 14, 2017

(54) IMAGE FORMING APPARATUS HAVING PHOTOSENSOR CLEANER AND METHOD OF CONTROLLING THE PHOTOSENSOR CLEANER

(71) Applicant: SAMSUNG ELECTRONICS CO., LTD., Suwon-si, Gyeonggi-do (KR)

(72) Inventors: Young Kook Park, Suwon-si (KR); Young Hwa Song, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/788,979

(22) Filed: Jul. 1, 2015

(65) Prior Publication Data

US 2016/0026145 A1 Jan. 28, 2016

(30) Foreign Application Priority Data

Jul. 24, 2014 (KR) ..... 10-2014-0094221

(51) Int. Cl.

*G03G 15/00* (2006.01)
*G03G 21/00* (2006.01)
*G03G 15/16* (2006.01)

(52) U.S. Cl.

CPC ..... *G03G 21/0005* (2013.01); *G03G 15/1605* (2013.01); *G03G 15/5058* (2013.01); *G03G 21/00* (2013.01)

(58) Field of Classification Search

CPC ..... G03G 21/0005; G03G 15/1605; G03G 2215/00042; G03G 2215/0897
See application file for complete search history.

(56) References Cited

U.S. PATENT DOCUMENTS 5,097,293 A * 3/1992 Seto ..... G03G 15/0848 399/11
2009/0016762 A1* 1/2009 Ota ..... G03G 15/5041 399/74

FOREIGN PATENT DOCUMENTS

| | | | |
|---|---|---|---|
| JP | 02-230173 | A | 9/1990 |
| JP | 2004-271718 | A | 9/2004 |
| JP | 2005-091912 | A | 4/2005 |
| JP | 2007-322677 | A | 12/2007 |
| KR | 10-2007-0001398 | | 1/2007 |

OTHER PUBLICATIONS

Machine translation of JP 2005-091912.*
European Search Report dated Dec. 9, 2015 issued in corresponding European Patent Application 15176215.0.

* cited by examiner

*Primary Examiner* — G.M. Hyder
(74) *Attorney, Agent, or Firm* — Staas & Halsey LLP

(57) ABSTRACT

Disclosed herein are an image forming apparatus and method that determines whether a photo sensor used for color registration is contaminated and a contamination level thereof so as to automatically clean the photo sensor. The image forming apparatus includes an intermediate transfer medium onto which images having different colors are to be overlapped and transferred, a photo sensor which emits light to receive light reflected by the intermediate transfer medium, a cleaning unit which cleans the photo sensor, and a control unit which controls the cleaning unit to clean the photo sensor based on an amount of light received by the photo sensor meeting a contamination indicating threshold.

21 Claims, 14 Drawing Sheets

IMAGE FORMING APPARATUS HAVING PHOTOSENSOR CLEANER AND METHOD OF CONTROLLING THE PHOTOSENSOR CLEANER

CROSS-REFERENCE TO RELATED APPLICATIONS

This application claims the benefit of Korean Patent Application No. 10-2014-0094221, filed on Jul. 24, 2014 in the Korean Intellectual Property Office, the disclosure of which is incorporated herein by reference.

BACKGROUND OF THE INVENTION

1. Field of the Invention

One or more embodiments of the present invention relate to an image forming apparatus and method capable of forming an image on print media.

2. Description of the Related Art

In general, electrophotographic image forming apparatuses such as a laser printer, a digital copier, etc. are apparatuses which emit light onto a photosensitive medium charged to a preset potential, form an electrostatic latent image on an surface thereof, supply the image with a developing agent, develop the image to a visible image, and transfer the image onto a paper to print out the image.

In color image forming apparatuses, when images which have different colors are overlapped, if the images are not overlapped at a correct position, edges of the images are blurred, therefore the quality of the images is not good. Since this problem occurs due to various variables such as a changing of a developer, an increasing of the number of copies, a combination thereof, etc., a color registration process is needed to register images in which each color is overlapped and so as to transfer color images onto a correct position.

For this type of color registration, light can be emitted with respect to a preset overlap color pattern. Since the degree of reflectivity of light is different according to a color, when light reflected through a photo sensor is received, misalignment of overlapping position of a color pattern can be determined.

SUMMARY

Therefore, one or more embodiments provide an image forming apparatus and method that may determine whether a photo sensor used for color registration is contaminated and a contamination level thereof and automatically clean a photo sensor based on that determination.

One or more embodiments provide image forming apparatus, including an intermediate transfer medium onto which images having different colors are to be overlapped and transferred, a photo sensor configured to emit light to the intermediate transfer medium and detect received light reflected from the intermediate transfer medium, a cleaning unit to clean the photo sensor, and a control unit to perform a cleaning operation by determining an amount of the received light and controlling the cleaning unit to clean the photo sensor based on the amount of the received light meeting a contamination indicating threshold.

The contamination indicating threshold may be a reference amount of received light, and the control unit controls the cleaning unit to clean the photo sensor based on the amount of the received light being equal to or less than the reference amount of received light.

When the determined amount of received light is equal to or less than the reference amount of received light and an amount of the light emitted by the photo sensor is determined to be less than a reference amount of emitted light, the control unit may perform the cleaning operation by controlling the photo sensor to emit an increased amount of light onto the intermediate transfer medium and determine whether the photo sensor is contaminated based on the emitted increased amount of light.

When the determined amount of received light is equal to or less than the reference amount of received light and an amount of the light emitted by the photo sensor is determined to be equal to or greater than a reference amount of emitted light, the control unit may perform the cleaning operation by controlling the cleaning unit to clean the photo sensor.

In the cleaning operation, the control unit may determine a number of times to clean the photo sensor based on a determined difference between the amount of received light and the reference amount of received light.

The determined number of times to clean the photo sensor may be controlled to increase as the determined difference between the amount of received light and the reference amount of received light increases.

In the cleaning operation, the control unit may control the photo sensor to emit light again and again receive light reflected by the intermediate transfer medium, after the cleaning unit cleans the photo sensor, to determine whether to again clean the photo sensor.

The image forming apparatus may further include a display unit which externally indicates a failure of the image forming apparatus when the amount of received light is determined to be equal to or less than a reference amount of received light and a number of repeated light emissions of the photo sensor, performed during the cleaning operation, is determined to be equal to or greater than a preset critical number of repeated light emissions.

When the amount of the received light does not meet the contamination indicating threshold, the control unit may controls the photo sensor to rotate the intermediate transfer medium in one direction and performs a color registration operation that senses a change in an amount of light reflected by the rotating intermediate transfer medium.

In the color registration operation, the control unit may determine transfer positions of images having different colors on the intermediate transfer medium based on a change in an amount of light sensed by the photo sensor.

The cleaning unit may include a shutter which transmits or blocks light emitted by the photo sensor, and a cleaner provided on one surface of the shutter to be contactable with the photo sensor to perform the cleaning of the photo sensor.

The cleaner may be spaced apart from the photo sensor when the shutter transmits light, and is in contact with the photo sensor when the shutter blocks light.

The image forming apparatus may further include a containment container, collocated with the photo sensor, that accommodates a contaminant removed by the cleaning unit.

The contaminant container may include an opening portion facing the cleaning unit.

One or more embodiments may provide an image forming method, including emitting light onto an intermediate transfer medium using a photo sensor, receiving light reflected by the intermediate transfer medium using the photo sensor, and cleaning the photo sensor based on an amount of the received light meeting a contamination indicating threshold.

The contamination indicating threshold may be a reference amount of received light, such that the cleaning of the photo sensor includes cleaning the photo sensor based on the amount of the received light being equal to or less than the reference amount of received light.

The method may further include, when the amount of received light is equal to or less than the reference amount of received light and an amount of the light emitted by the photo sensor is less than a reference amount of emitted light, emitting an increased amount of light onto the intermediate transfer medium and determining whether the photo sensor is contaminated based on the emitted increased amount of light.

The cleaning of the photo sensor may include, when the amount of received light is equal to or less than the reference amount of received light and an amount of the light emitted by the photo sensor is equal to or greater than a reference amount of emitted light, cleaning the photo sensor.

The cleaning of the photo sensor may include determining a number of times to clean the photo sensor based on a determined difference between the amount of received light and the reference amount of received light.

In the determining of the number of times to clean the photo sensor, the determined number of times to clean the photo sensor may be controlled to increase as the determined difference between the amount of received light and the reference amount of received light increases.

The method may further include emitting light again and again receiving light reflected by the intermediate transfer medium, automatically after cleaning the photo sensor, to determine whether to again clean the photo sensor.

The method may further include externally indicating a failure of an image forming apparatus when the amount of received light is equal to or less than a reference amount of the received light, represented by the contamination indicating threshold, and a number of repeated light emissions of the photo sensor, corresponding to the determining of whether to again clean the photo sensor, is determined to be equal to or greater than a preset critical number of repeated light emissions.

The method may further include rotating the intermediate transfer medium in one direction when the amount of received light fails to meet the contamination indicating threshold, and performing a color registration operation by sensing a change in an amount of light reflected by the rotating intermediate transfer medium.

The color registration operation may further include determining transfer positions of images having different colors on the intermediate transfer medium based on the sensed change in the amount of light reflected by the rotating intermediate transfer medium The method may further include transferring plural toner images onto the intermediate transfer medium, based on the color registration operation, and transferring the plural toner images from the intermediate transfer medium to paper.

Additional aspects and/or advantages will be set forth in part in the description which follows and, in part, will be apparent from the description, or may be learned by practice of one or more embodiments of the present invention.

BRIEF DESCRIPTION OF THE DRAWINGS

These and/or other aspects of the invention will become apparent and more readily appreciated from the following description of embodiments, taken in conjunction with the accompanying drawings of which.

DETAILED DESCRIPTION OF THE PREFERRED EMBODIMENTS

Figure 1:
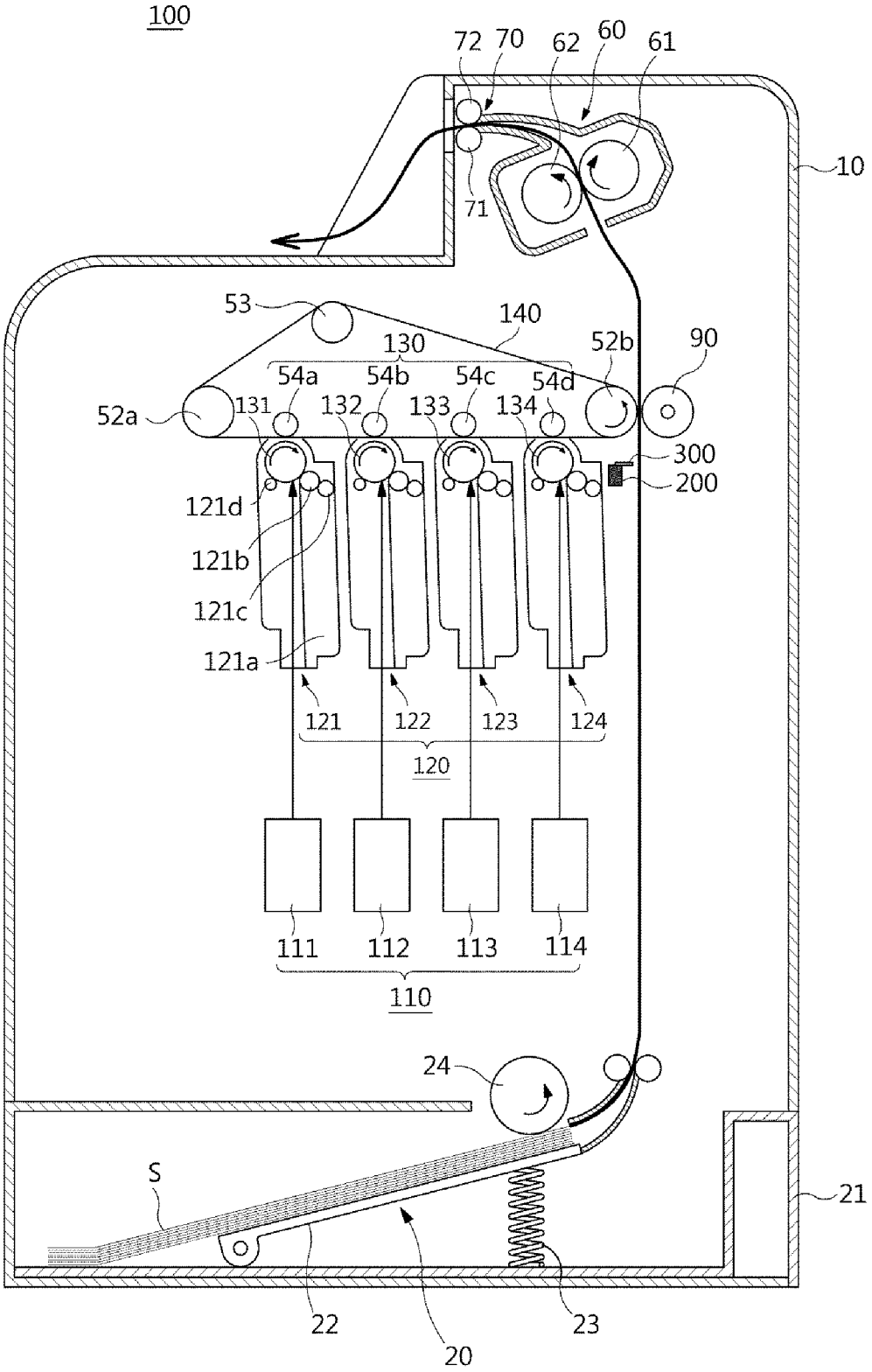
FIG. 1 is a side view of an image forming apparatus in accordance with one or more embodiments.

Reference will now be made in detail to one or more embodiments of the present invention, illustrated in the accompanying drawings, wherein like reference numerals refer to like elements throughout. In this regard, embodiments of the present invention may be embodied in many different forms and should not be construed as being limited to embodiments set forth herein. Accordingly, embodiments are merely described below, by referring to the figures, to explain aspects of the present invention.

As only an example, one or more embodiments demonstrate an image forming apparatus which forms a color image using a single path method.

FIG. 1 is a side view of an image forming apparatus in accordance with one or more embodiments.

The image forming apparatus may include a paper feed unit 20, an exposure unit 110, a developing unit 120, a photosensitive unit 130, an intermediate transfer medium 140, a transfer roller 90, a fixing unit 60, and a paper ejection unit 70, included in a body 10 which forms an exterior thereof. An arrow connected from the paper feed unit 20 to the paper ejection unit 70 in FIG. 1 refers to a conveyance path of a paper S.

The paper feed unit 20 includes a paper feed cassette 21 detachably coupled to a lower portion of the body 10, a paper pressure plate 22 configured to vertically pivot inside the paper feed cassette 21 on which the paper S is placed, an elastic member 23 disposed under a lower portion of the paper pressure plate 22 and elastically supports the paper pressure plate 22, and a pick-up roller 24 disposed on a front end of the paper S placed on the paper pressure plate 22 and picks up the paper S. The paper S is picked up by the pick-up roller 24 and is transported along a conveyance path, and a roller or a supporter which assists the conveyance of the paper S may be further included in the paper conveyance path according to necessity.

The exposure unit 110 may use a laser scan unit (LSU) which emits light corresponding to image information of a plurality of different colors, for example, black (K), yellow (Y), magenta (M), and cyan (C), onto the photosensitive unit 130 and uses a laser diode as a light source.

Since the exposure unit 110 may include a plurality of exposure portions which correspond to each color, the exposure unit 110 in accordance with one or more embodiments of the present invention may include a first exposure portion 111, a second exposure portion 112, a third exposure portion 113, and a fourth exposure portion 114, which correspond to four colors. Since each exposure portion emits light onto the corresponding photosensitive portion and forms an electrostatic latent image, the photosensitive unit 130 may include a first photosensitive portion 131, a second photosensitive portion 132, a third photosensitive portion 133, and a fourth photosensitive portion 134, which correspond to each color. Here, the photosensitive portion may be a photosensitive drum in which a photoconductive layer is formed on an external circumference of a metallic drum in a cylindrical shape, and the order from the first photosensitive portion 131 to the fourth photosensitive portion 134 is determined based on a conveying direction of the intermediate transfer medium 140.

The developing unit 120 includes a first developing unit 121, a second developing unit 122, a third developing unit 123, and a fourth developing unit 124 which respectively accommodate toners having different colors, for example, black (K), yellow (Y), magenta (M), and cyan (C).

The first developing unit 121 include a first toner storage portion 121*a* in which a toner is stored, a first charging roller 121*d* for charging the first photosensitive portion 131, a first developing roller 121*b* for developing an electrostatic latent image formed on the first photosensitive portion 131 to a toner image, and a first supply roller 121*c* for supplying a first toner to the first developing roller 121*b*. Each of the remaining developing units 122, 123, and 124 also include a toner storage portion, an electrostatic charging roller, a developing roller, and a supply roller.

The intermediate transfer medium 140 serves as an intermediate medium for transferring a toner image developed on an external circumference surface of each of the photosensitive portions 131, 132, 133, and 134 onto the paper S. The intermediate transfer medium 140 may include a circulating intermediate transfer belt which contacts each of the photosensitive portions 131, 132, 133, and 134, and driving rollers 52*a* and 52*b* may drive the intermediate transfer medium 140 and a supporting roller 53 may maintain the tension of the intermediate transfer medium 140. In addition, the image forming apparatus 100 may include four intermediate transfer rollers 54*a*, 54*b*, 54*c*, and 54*d* for transferring a toner image developed on an external circumference surface of each of the photosensitive portions 131, 132, 133, and 134 onto the intermediate transfer medium 140.

The transfer roller 90 is installed to face the driving roller 52*b* of the intermediate transfer medium 140, rotates together with the driving roller 52*b* and pass the paper S between one surface of the intermediate transfer medium 140 and the transfer roller 90, and thus transfers a toner image developed on the intermediate transfer medium 140 onto the paper S.

The fixing unit 60 heats and presses the paper S to fix a toner image on the paper S. The fixing unit 60 includes a heating roller 61 which has a heat source for heating a paper onto which a toner is transferred, and a pressing roller 62 installed opposite the heating roller 61 and configured to maintain a constant fixing pressure between the heating roller 61 and the fixing unit 60.

The paper ejection unit 70 is for ejecting the paper S on which printing is completed to outside of the body 10, and includes a paper ejection roller 71 and a back-up roller 72 which rotates with the paper ejection roller 71.

A printing process of the above-described image forming apparatus of FIG. 1, in accordance with one or more embodiments, will be described below.

The first exposure portion 111 forms an electrostatic latent image corresponding to first color image information on the first photosensitive portion 131, and the first developing unit 121 supplies a first color toner to the electrostatic latent image. As a result, the first toner image may be formed on an external circumference surface of the first photosensitive portion 131.

The second exposure portion 112 forms an electrostatic latent image corresponding to second color image information on the second photosensitive portion 132, and the second developing unit 122 supplies a second color toner to the electrostatic latent image. As a result, the second toner image may be formed on an external circumference surface of the second photosensitive portion 132.

The third exposure portion 113 forms an electrostatic latent image corresponding to third color image information on the third photosensitive portion 133, and the third developing unit 123 supplies a third color toner to the electrostatic latent image. As a result, the third toner image may be formed on an external circumference surface of the third photosensitive portion 133.

The fourth exposure portion 114 forms an electrostatic latent image corresponding to fourth color image information on the fourth photosensitive portion 134, and the fourth developing unit 124 supplies a fourth color toner to the electrostatic latent image. As a result, the fourth toner image may be formed on an external circumference surface of the fourth photosensitive portion 134.

The first to fourth toner images which are formed on the first to fourth photosensitive portion 131, 132, 133, and 134 may be transferred onto the intermediate transfer medium 140. At this time, in order to form a desired color image, the first to fourth toner images may be overlapped and transferred onto the intermediate transfer medium 140.

The first to fourth toner images are overlapped on the intermediate transfer medium 140 and may be formed in one color image. The formed color image according to the process is transferred onto a paper, and the printing process is completed.

As described above, in the printing process in accordance to one or more embodiments, a process, in which the first to fourth toner images are overlapped and transferred onto the intermediate transfer medium 140, desires accuracy as a previous operation for forming one color image. Specifically, a start position and a finish position for transferring all of the first to fourth toner images onto the intermediate transfer medium 140 should be the same.

When transferred positions of the first to fourth toner images are different from each other, the first to fourth toner images may be misaligned and incorrectly overlap. As a result, the quality of a finally formed color image may be degraded.

In order to sense and correct for, or avoid, this type of misalignment in advance, the above-described image forming apparatus of FIG. 1 may perform auto color registration (ACR) according to one or more embodiments.

First, a first ACR pattern may be formed on an external circumference surface of a first photosensitive portion 131 using a first exposure portion and a first developing unit. In addition, a second ACR pattern may be formed on an external circumference surface of a second photosensitive portion 132 using a second exposure portion and a second developing unit. In addition, a third ACR pattern may be formed on an external circumference surface of a third photosensitive portion 133 using a third exposure portion and a third developing unit, and a fourth ACR pattern may be formed on an external circumference surface of a fourth photosensitive portion 134 using a fourth exposure portion and a fourth developing unit.

Here, a total reflection or a scattered reflection pattern may be used for the formed first to fourth ACR patterns, but the present invention is not limited thereto.

Next, the first to fourth ACR patterns may be overlapped and transferred onto an intermediate transfer medium 140. Specifically, as the intermediate transfer medium 140 rotates in one direction, the first to fourth ACR patterns which are formed on the external circumference surfaces of the first to fourth photosensitive portions 131, 132, 133, and 134 may be overlapped and transferred. As a result, a color ACR pattern may be formed on the intermediate transfer medium 140.

When the color ACR pattern is formed on the intermediate transfer medium 140, light may be emitted onto the intermediate transfer medium 140 using a photo sensor 200. The emitted light is reflected by the color ACR pattern, and may be received in the photo sensor 200.

Since the intermediate transfer medium 140 unidirectionally rotates, the photo sensor 200 may scan the entire formed color ACR pattern. Therefore, a forming state of the color ACR pattern may be sensed using the changed amount of light received by the photo sensor 200. That is, when the changed or differing amount of light sensed by the photo sensor 200 is analized, each of the correct transfer positions where the first to fourth ACR patterns are transferred onto the intermediate transfer medium 140 may be determined.

When there are misalignments of the sensed transferred positions, a correction may be performed by controlling exposing start time of any of the first to fourth exposure portions, for example.

As described above, according to one or more embodiments, the ACR may be performed based on the differing amount of the light sensed by the photo sensor 200. Therefore, a more accurate result may be obtained as the photo reception rate of the photo sensor 200 is higher.

When the image forming apparatus repeats a printing process, a photoreceptor of the photo sensor 200 may become contaminated by a contaminant M which may include a toner, dust, etc., for example. Since the contaminant M disturbs the light receiving of the photo sensor 200, the photo reception rate of the photo sensor 200 may decrease. As a result, it may become difficult for the photo sensor 200 to accurately identify the forming state of the color ACR pattern.

Therefore, addressing such a need, the image forming apparatus may determine whether a photo sensor is contaminated and clean the photo sensor 200 in response to that determination. For example, the image forming apparatus may include a cleaning unit 300 for cleaning the photo sensor 200.

Figure 2:
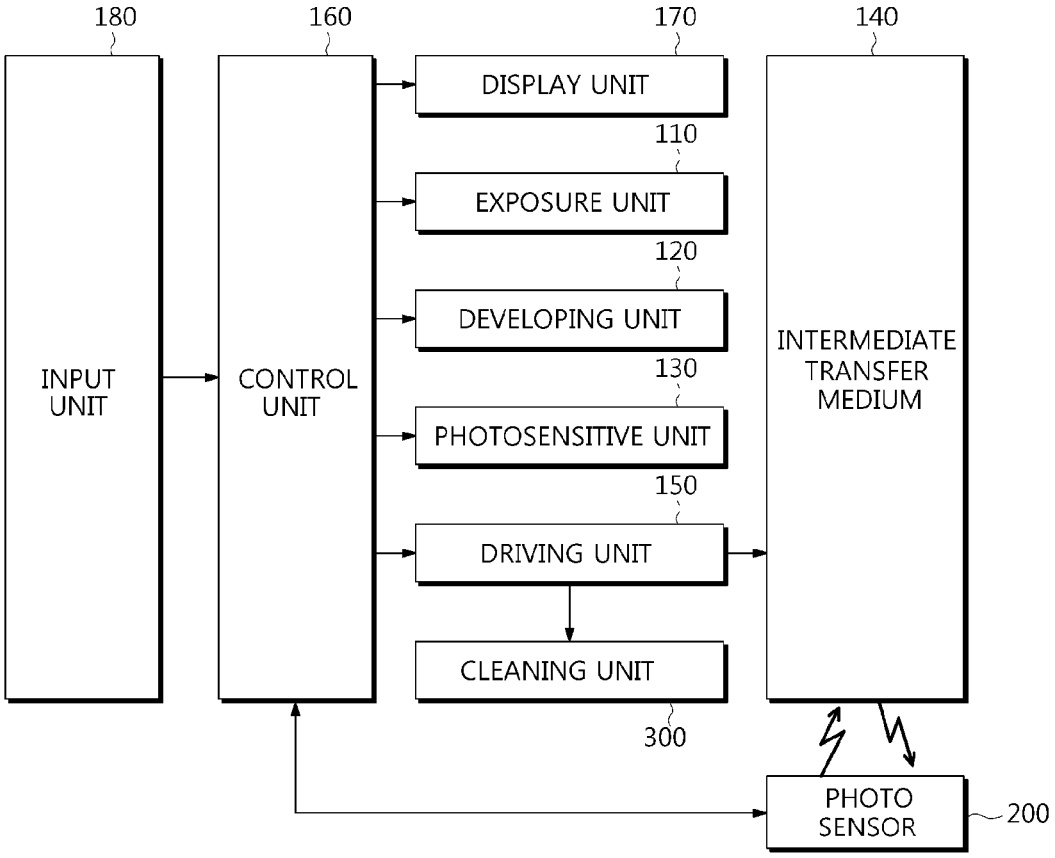
FIG. 2 is a block diagram for describing control of an image forming apparatus in accordance with one or more embodiments.

FIG. 2 is a block diagram for describing control of an image forming apparatus in accordance with one or more embodiments.

The image forming apparatus may include an exposure unit 110, a developing unit 120, a photosensitive unit 130, an intermediate transfer medium 140, a driving unit 150, a control unit 160, a display unit 170, an input unit 180, a photo sensor 200, and a cleaning unit 300.

Descriptions of the exposure unit 110, the developing unit 120, the photosensitive unit 130, and the intermediate transfer medium 140, are omitted since the descriptions are the same as those of FIG. 1.

The input unit 180 may input a control command of the image forming apparatus from a user. For example, the input unit 180 may input the control command such as power supply on/off, paper ejection, or test printing, etc. The input unit 180 may transmit the input control command to the control unit 160 which will be described below.

The photo sensor 200 may emit light and receive light reflected by an intermediate transfer medium 140. To this end, the photo sensor 200 may include a light emitting portion which emits light, and a photoreceptor which receives the reflected light.

The light emitting portion may emit light onto the intermediate transfer medium 140. Specifically, as only examples, the light emitting portion may emit light onto an area of the intermediate transfer medium 140 before an image is transferred from a photosensitive unit 130, or onto an area of the intermediate transfer medium 140 where the image is not transferred from the photosensitive unit 130.

The light emitting portion may increase the amount of emitted light according to supplied current. The current supplied to the light emitting portion may be determined by a pulse width modulation (PWM) duty value, for example.

A photoreceptor may receive light emitted onto and reflected by the intermediate transfer medium 140, and may convert the received light to a current. That is, more current is generated as the amount of the received light increases.

The control unit 160 may determine whether to clean or not clean the photo sensor 200 based on the amount of light received by a photoreceptor. Thus, the control unit 160 may determine to clean the photo sensor 200 when the amount of light received by the photoreceptor meets a threshold, e.g., when indicated amount of received light is equal to or less than a reference amount of received light.

The reference amount of received light may be a preset reference amount of received light. Here, for example, the preset reference amount of received light may refer to a maximum or threshold amount of received light at which point the photoreceptor may then be considered to be contaminated, or sufficiently contaminated, and in need of cleaning. The preset reference amount of received light may be determined by a user input, an internal operation of an image forming apparatus, or a hardware design of an image forming apparatus, depending on embodiment.

When the control unit 160 determines that cleaning of the photo sensor 200 is needed, the control unit 160 may control a cleaning unit 300 to clean the photo sensor 200. Specifically, the control unit 160 may control a driving unit 150 to transmit power to the cleaning unit 300.

Figure 3A:
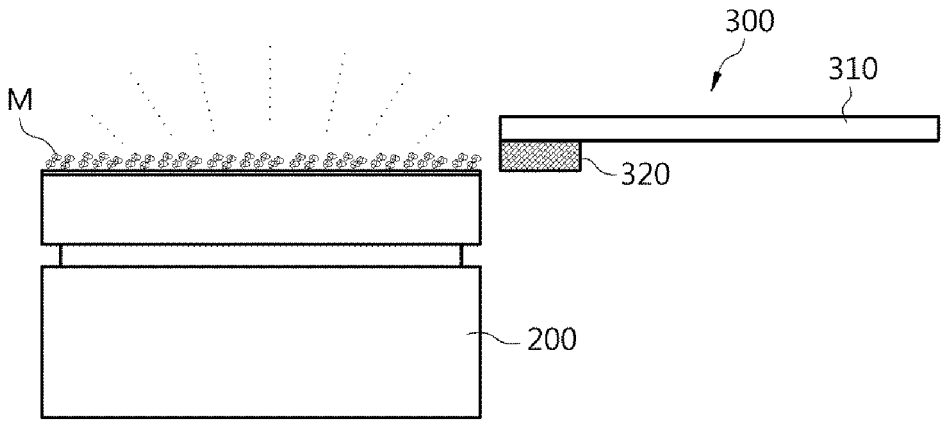
FIGS. 3A to 3C are views showing various examples of cleaning units of an image forming apparatus in accordance with one or more embodiments.
Figure 3B:
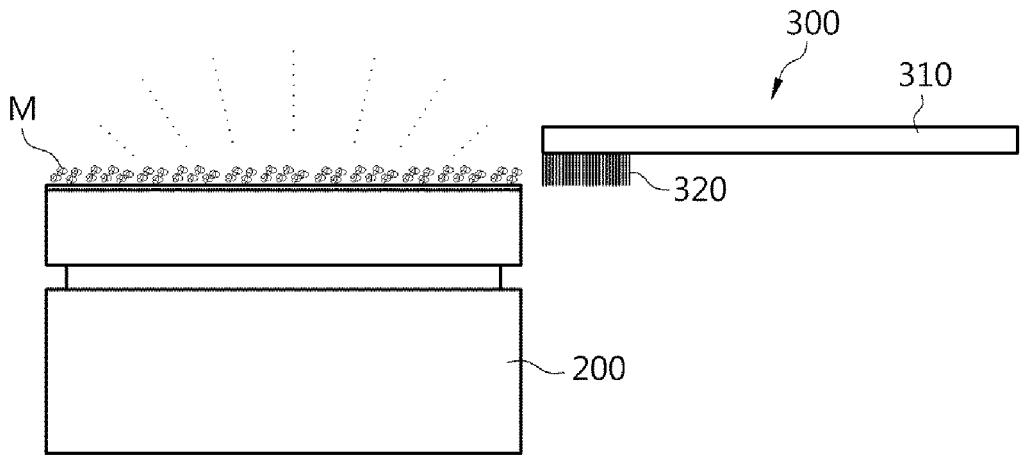
Figure 3C:
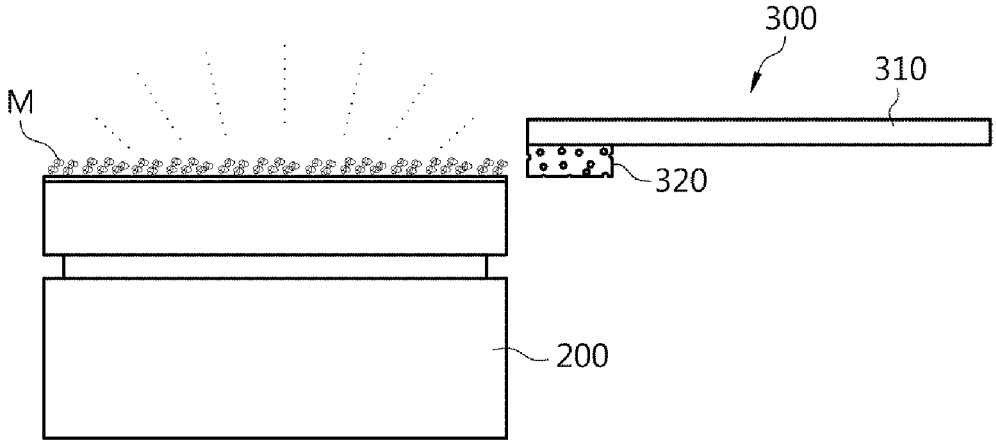

FIGS. 3A to 3C are views illustrating various examples of a cleaning unit 300 of an image forming apparatus in accordance with one or more embodiments.

A cleaning unit 300 may be provided to clean a photo sensor 200. Specifically, the cleaning unit 300 may include a shutter 310 which transmits or blocks light emitted by the photo sensor 200, and a cleaner 320 which is able to contact the photo sensor 200 and is disposed on one surface of the shutter.

The cleaner 320 may be provided to be able to contact a photoreceptor of the photo sensor 200. Therefore, the cleaner 320 may remove a contaminant M of the photoreceptor through rubbing.

Referring to FIG. 3A, the cleaner 320 may be made of a fabric. Specifically, as only an example, the cleaner 320 may be made of cotton flannel. When the cleaner 320 is made of the fabric, the cleaner 320 is capable of removing the contaminant M without damage to the photo sensor 200.

Alternatively, the cleaner 320 may be formed in a brush shape. FIG. 3B shows an example of the cleaner 320 in the brush shape. When the cleaner 320 is formed in the brush shape, it is capable of removing a contaminant M that is strongly attached to the photo sensor 200.

In addition, the cleaner 320 may be provided as a sponge. FIG. 3C shows an example in which the cleaner 320 provided as a sponge. The cleaner 320 provided as the sponge may be capable of removing a liquid contaminant M, and may minimize damage to the photo sensor 200 compared to the fabric or brush approaches.

However, FIGS. 3A-3C are only demonstrating various examples of a cleaner 320. The cleaner 320 may be implemented in various additional or alternate ways within the technical concept of the present invention to remove the contaminant M from the photo sensor 200.

Since a cleaner 320 is disposed on one surface of a shutter 310, the cleaner 320 may perform a process of cleaning a photo sensor 200 according to movement of the shutter 310. Specifically, in an embodiment, only when the shutter 310 is moved to block light, can the cleaner 320 contact the photo sensor 200. As only an example, the shutter 310 may only move when the shutter 310 receives driving power supplied from a driving unit 150.

Figure 4A:
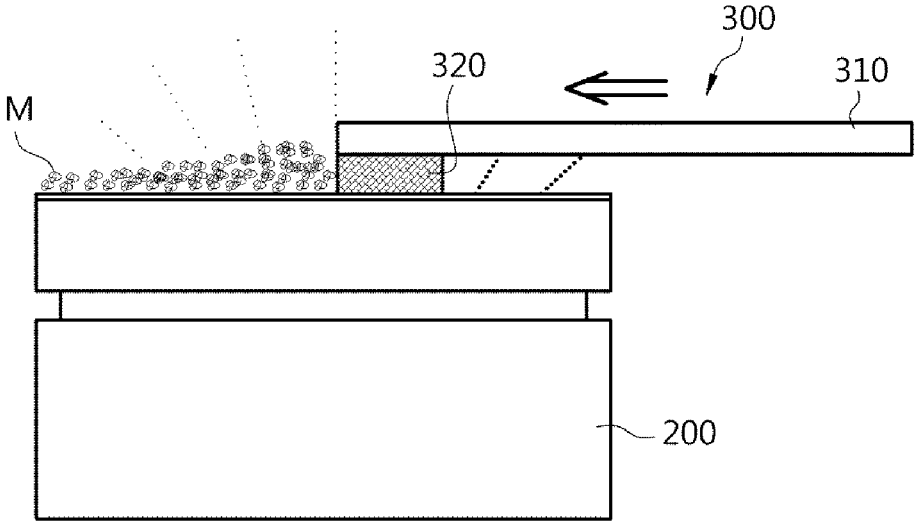
FIGS. 4A and 4B are views for describing a cleaning method of a photo sensor of an image forming apparatus in accordance with one ore more embodiments.
Figure 4B:
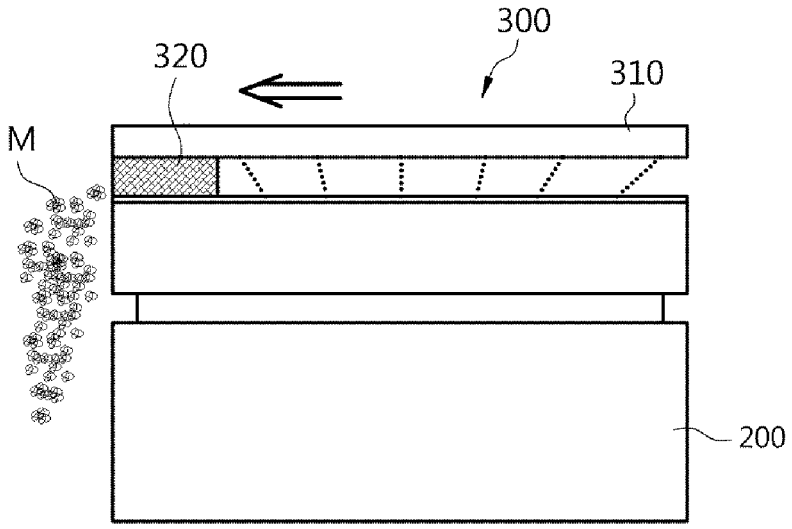

FIGS. 4A and 4B are views for describing a cleaning method of a photo sensor 200 of an image forming apparatus in accordance with one or more embodiments.

To clean a contaminated photo sensor 200, a cleaner 320 may be needed to contact the photo sensor 200. The cleaning process of the photo sensor 200 may be performed by moving a shutter 310.

As shown in FIG. 4A, the shutter 310 may be moved in one direction so that the cleaner 320 may contact the photo sensor 200. Here, the one direction may refer to the moving direction of the shutter 310 which blocks light emitted by the photo sensor 200. In FIG. 4A, the illustrated direction of the arrow is a moving direction of the shutter 310.

When the cleaner 320 contacts the photo sensor 200 and is moved in the same direction as the shutter 310, a contaminant M may also be caused to move along the moving direction of the shutter 310 by rubbing.

Referring to FIG. 4B, the shutter 310 may be moved in the moving direction until light emitted by the photo sensor 200 is blocked completely. According to the movement of the shutter 310, the cleaner 320 may also be moved to one end of the photo sensor 200 and may thereby perform the cleaning process.

Thus, the contaminant M may be separated to be removed from the photo sensor 200. When the cleaning process of the photo sensor 200 is completed, a photo reception rate may increase due to the removal of the contaminant, and thus a color ACR pattern can be accurately sensed.

In contrast to FIGS. 4A and 4B, a shutter 310 may include an opening portion. The shutter 310 may also transmit light through the opening portion, and may be moved in one direction to block light. A cleaner 320 disposed on one surface of the shutter 310 may clean the photo sensor 200 according to movement of the shutter 310 as described above.

A cleaning process may be defined from a time when a cleaner 320 contacts a photo sensor 200 to a time when the cleaner 320 moving in one direction stops. A control unit 160 may determine the number of times to implement the cleaning process, e.g., according to the contamination level of the photo sensor 200, as will be described in greater detail below.

Figure 5A:
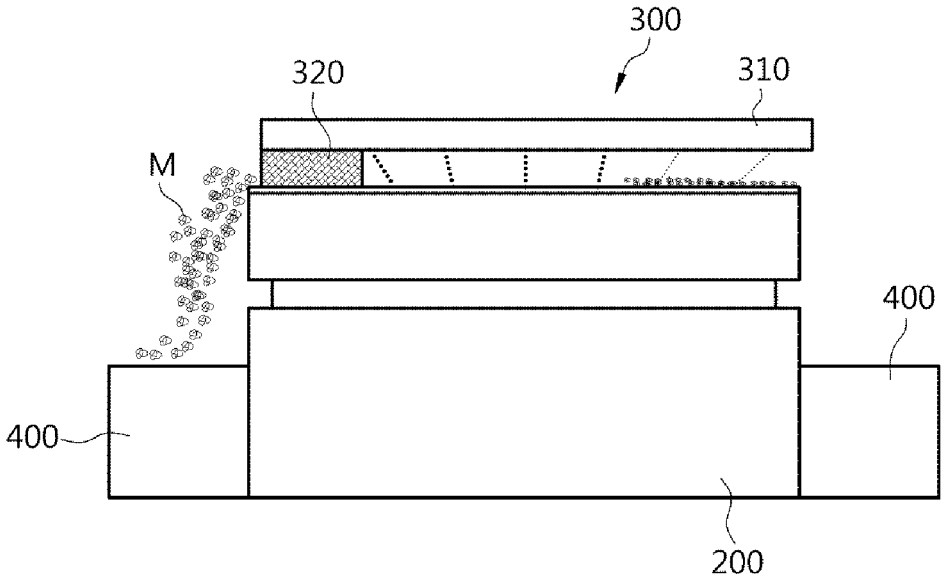
FIGS. 5A and 5B are views for describing an operation of a contaminant container of an image forming apparatus in accordance with one ore more embodiments.
Figure 5B:
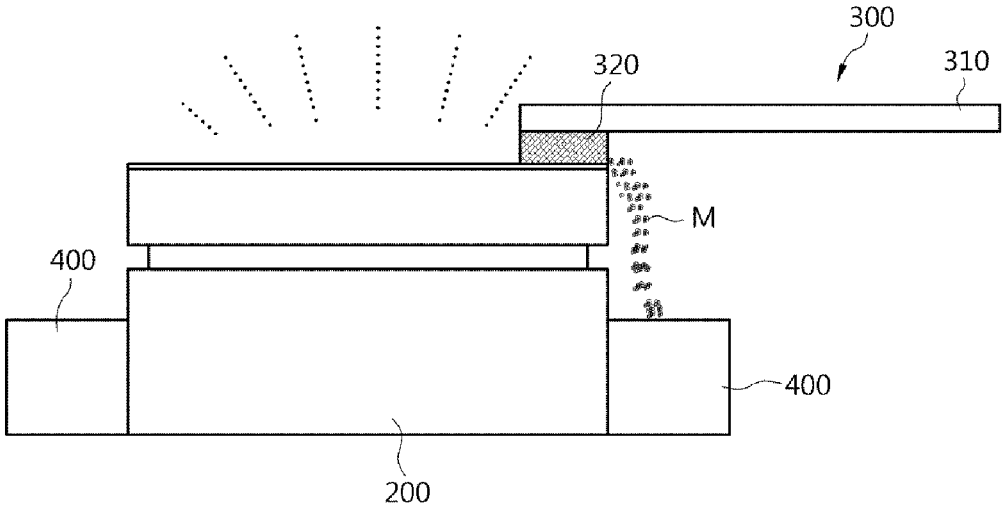

FIGS. 5A and 5B are views for describing an operation of a contaminant container of an image forming apparatus in accordance with one or more embodiments.

In FIGS. 5A and 5B, it may be assumed that one surface of a photo sensor 200 from which light is emitted is an upper surface and the other surface opposite the upper surface is a lower surface.

A photo sensor 200 may further include a contaminant container 400 which accommodates a contaminant M removed by a cleaning unit 300. The contaminant container 400 may be disposed on a path on which a cleaner 320 is moved. In addition, the contaminant container 400 may include an opening portion which faces the cleaning unit 300. As a result, the contaminant M moved together with the moving cleaner 320 may be accommodated in the contaminant container 400 through the opening portion.

The contaminant container 400 may be disposed on a side surface of the photo sensor 200. In FIGS. 5A and 5B, even though the photo sensor 200 is illustrated as including two contaminant containers 400, the number of contaminant containers 400 is not limited thereto.

As shown in FIG. 5A, when the cleaner 320 reaches one end of the photo sensor 200, the contaminant M moved in the same direction may be accommodated in an adjacent contaminant container 400. In addition, as shown in FIG. 5B, when the cleaner 320 reaches the other end of the photo sensor 200, the contaminant M moved together with cleaner 320 to the other end may be accommodated in an adjacent contaminant container 400.

When the photo sensor 200 is provided with the contaminant container 400 which accommodates the contaminant M, the contaminant M separated from the photo sensor 200 may be prevented from being deposited inside the image forming apparatus.

In addition, the contaminant container 400 may be provided to be separable from the photo sensor 200. When the contaminant container 400 may be separable from the photo sensor 200, it is easy for a user to discharge the contaminant M from the inside of the image forming apparatus to the outside thereof.

Referring again to FIG. 2, when the amount of light received by a photo sensor 200 meets a threshold, e.g., is equal to or less than the reference amount of received light, and the amount of light emitted from the photo sensor 200 meets a threshold, e.g., is less than a reference amount of emitted light, a control unit 160 may control the photo sensor 200 to increase the amount of the light that is to be emitted onto an intermediate transfer medium 140.

The reference amount of emitted light may be a preset reference amount of emitted light. Here, for example, the preset reference amount of emitted light may refer to a maximum amount of light that may be emitted by the photo sensor 200. The preset reference amount of emitted light may also be determined by a user input, an internal operation of the image forming apparatus, or a hardware design of the image forming apparatus, depending on embodiment.

For example, when the photo sensor 200 emits light with an Lv of 1 to receive light reflected by the intermediate transfer medium 140, the control unit 160 determines whether the amount of the received light is equal to or less than the reference amount of received light. When the amount of the received light is equal to or less than the reference amount of received light, the control unit 160 determines whether the emitted light with an Lv of 1 is less than the reference amount of emitted light. When the maximum amount of light emitted by the photo sensor 200 has an Lv of 5, the control unit 160 may determine the emitted light with an Lv of 1 is less than the reference amount of emitted light with an Lv of 5. Therefore, the control unit 160 may control the photo sensor 200 to emit light from the Lv of 1 to an Lv of 2.

Meanwhile, when the amount of light received by the photo sensor 200 is equal to or less than the reference amount of received light and the amount of light emitted from the photo sensor 200 is equal to or greater than the reference amount of emitted light, the control unit 160 may control the cleaning unit 300 to clean the photo sensor 200.

For example, when the photo sensor 200 emits light with an Lv of 5 to receive reflected light by the intermediate transfer medium 140, the control unit 160 determines whether the amount of the received light is equal to or less than the reference amount of received light. When the amount of the received light is equal to or less than the reference amount of received light, the control unit 160 determines whether the emitted light with an Lv of 5 is equal to or greater than the reference amount of emitted light. When the maximum amount of light that may be emitted by the photo sensor 200 is an Lv of 5, the control unit 160 may determine that the emitted light with an Lv of 5 is equal to or greater than the reference amount of emitted light with an Lv of 5. Therefore, the control unit 160 may control the cleaning unit 300 to clean the photo sensor 200.

Thus, whether to perform cleaning or not cleaning of the photo sensor 200 may be determined by considering the amount of light emitted by photo sensor 200 in addition to the amount of light received by the photo sensor 200. That is, even when the amount of received light is small, if the amount of emitted light can be increased and the amount of received light can thereby be increased, it may not be necessary to perform an additional cleaning process.

In addition, the control unit 160 may determine the number of times to perform the cleaning process of the photo sensor 200, for example, based on a determined difference between the amount of light received by the photo sensor 200 and the reference amount of received light. Specifically, the control unit 160 may increase the number of times the cleaning process of the photo sensor 200 is performed when the determined difference between the amount of light received by the photo sensor 200 and the reference amount of received light is large.

Since the reference amount of received light refers to the maximum amount of light received through the contaminated photoreceptor which needs to cleaned, as explained above, it can be determined that the contamination level of the photo sensor 200 is large when the difference between the amount of light received by the photo sensor 200 and the reference amount of received light is increased.

For example, based on a reference amount of received light of 100, an amount of received light of 20 may indicate a higher contamination level than an amount of received light of 90. Therefore, the number of times the cleaning process is performed may be greater when the amount of received light is 20, compared to the amount of received light being 90.

The control unit 160 may determine the number of times to perform the cleaning process in proportion to the determined difference between the reference amount of received light and the amount of received light. Alternatively, the control unit 160 may clean the photo sensor 200 a number of times corresponding to an interval divided by the difference between the reference amount of received light and the amount of received light, as only examples.

When the photo sensor 200 is cleaned according to the contamination level, the contaminant M may be more effectively removed from the photo sensor 200.

In addition, the control unit 160 may control the cleaning unit 300 to clean the photo sensor 200 so as to emit light again to receive light reflected by the intermediate transfer medium 140.

Since the contaminant M may remain on the photo sensor 200 after the cleaning process is performed, as the photo sensor 200 emits light again to receive light reflected by the intermediate transfer medium 140, the control unit 160 may determine again whether the photo sensor 200 is contaminated.

In addition, when the amount of light received by the photo sensor 200 is equal to or less than the reference amount of received light and the number of times of performing the light emitting process in which the photo sensor 200 emits light is equal to or greater than a preset critical number of times, the control unit 160 may control a display unit 170 to externally display a failure of the image forming apparatus.

Here, the preset critical number of times may refer to the minimum number of times of performing the light emitting process which are needed to check an abnormal operation of the photo sensor 200. The critical number of times may be determined by a user input, an internal operation of the image forming apparatus, or a hardware design of the image forming apparatus.

For example, when the critical number of times is 3, and the number of times in which the amount of received light which is emitted is equal to or less than the reference amount of received light is 3, the display unit 170 may externally indicate a failure of the image forming apparatus.

The display unit 170 may indicate preset colors, shade, characters, figures, symbols, or shapes, which inform a failure. In addition, the display unit 170 may also additionally output a preset sound which indicates a failure.

In addition, when the amount of received light received by a photo sensor 200 is greater than the reference amount of received light, a control unit 160 may determine that the photo sensor 200 is not contaminated. Therefore, the control unit 160 may then perform an ACR process in accordance with one or more embodiments.

Specifically, the control unit 160 may transfer a color ACR pattern onto an intermediate transfer medium 140 which rotates in one direction. Since a method of the transferring a color ACR pattern onto the intermediate transfer medium 140 is the same as described above, a detail description thereof will be omitted.

Next, a control unit 160 emits light onto a rotating intermediate transfer medium 140 onto which a color ACR pattern is transferred, and controls the photo sensor 200 to sense a change in the amount of reflected light.

The photo sensor 200 senses a change in the amount of light, and the control unit 160 may sense a forming state of a color ACR pattern transferred onto an intermediate transfer medium 140 based on a change in the amount of sensed light. That is, the control unit 160 may determine each of the transfer positions at which intermediate transfer medium 140 are transferred by the first to fourth ACR patterns.

As a result, when there are misalignments in the transfer positions, the control unit 160 adjusts an exposing start time of any of the first to fourth exposure portions, as necessary, for a corrected alignment.

Figure 6:
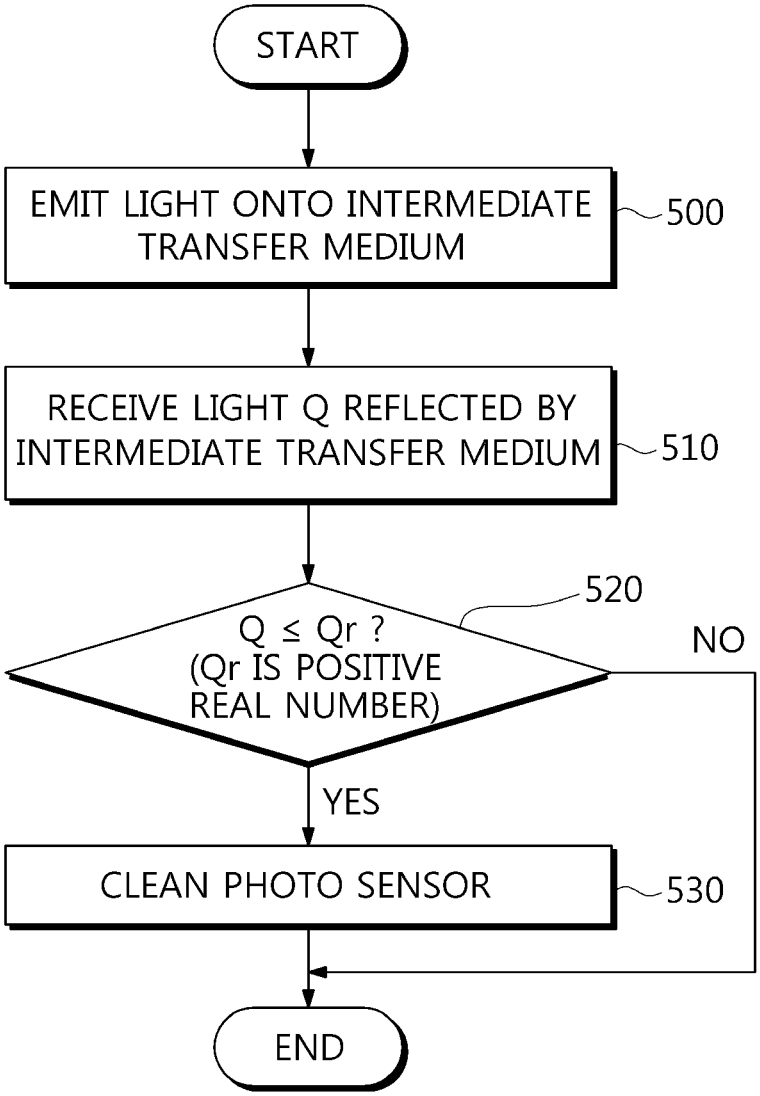
FIG. 6 is a flow chart illustrating an image forming method in accordance with one or more embodiments.

FIG. 6 is a flow chart illustrating an image forming method in accordance with one or more embodiments.

First, light may be emitted onto an intermediate transfer medium 140 (S500).

The method may be performed by a light emitting portion of a photo sensor 200. The light emitting portion of the photo sensor 200 may generate light in which the amount of light corresponds to input current and may emit light onto the intermediate transfer medium 140.

Light Q reflected by the intermediate transfer medium 140 may be received corresponding to the emitted light (S510). Here, Q may refer to the amount of light.

The light Q reflected by the intermediate transfer medium 140 may be received by a photoreceptor of the photo sensor 200. The photoreceptor may output current corresponding to the light Q.

Next, it is determined whether the light Q received by photoreceptor meets a threshold, e.g., is equal to or less than a preset reference amount of received light Qr (S520). Here, for example, the preset reference amount of received light Qr may refer to the maximum amount of light received from a contaminated photoreceptor which needs to be cleaned, as explained above. The preset reference amount of received light Qr may be determined by a user input, an internal operation of the image forming apparatus, or a hardware design of the image forming apparatus, depending on embodiment.

For example, when the light Q is greater than the preset amount of received light Qr, the photo sensor 200 may be determined to not be contaminated, and thus the method may be completed without an additional cleaning process.

However, in this example, when the light Q is equal to or less than the preset amount of received light Qr, the photo sensor 200 may be determined to be contaminated. Therefore, the photo sensor may be cleaned (S530). The photo sensor 200 may be cleaned by the cleaning unit 300.

Figure 7:
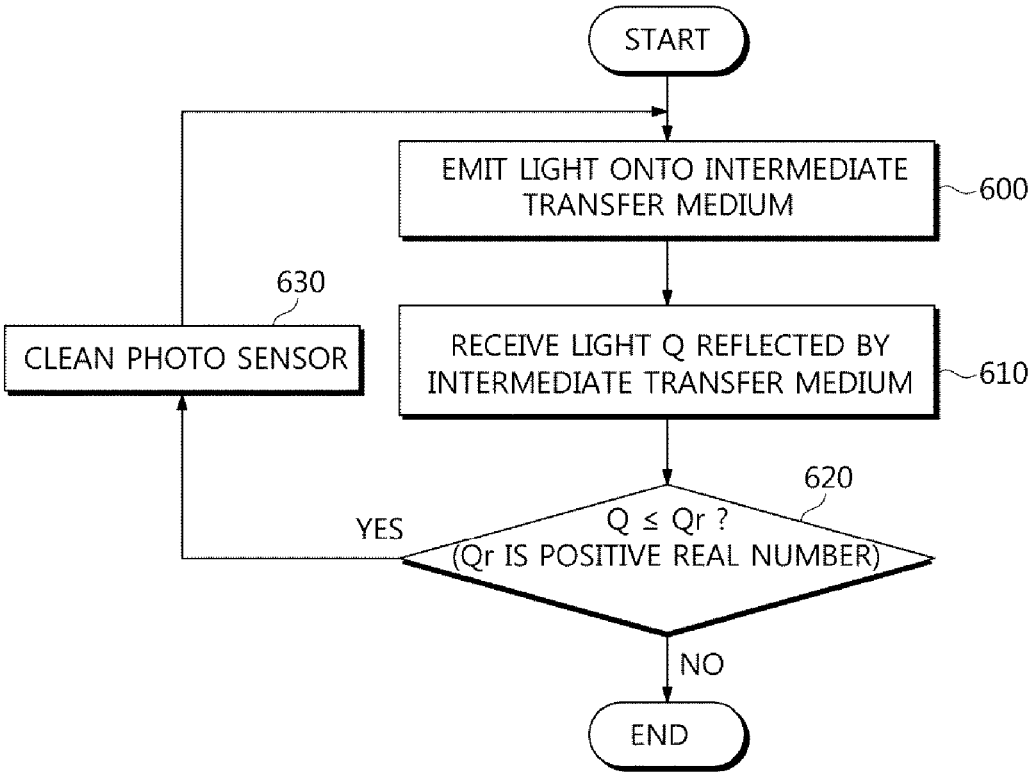
FIG. 7 is a flow chart illustrating an image forming method in accordance with one or more embodiments.

FIG. 7 is a flow chart illustrating an image forming method in accordance with one or more embodiments.

First, light may be emitted onto an intermediate transfer medium 140 using a light emitting portion of a photo sensor (S600).

A photoreceptor of the photo sensor 200 may receive light Q reflected from the intermediate transfer medium 140 corresponding to the emitted light (S610). Here, Q may refer to the amount of light.

Next, it is determined whether the light Q received by the photoreceptor meets a threshold, e.g., is equal to or less than the preset amount of received light Qr (S620). For example, when the light Q is greater than the preset amount of received light Qr, the photo sensor 200 may be determined to not be contaminated, and thus the method may be completed without an additional cleaning process.

However, in this example, when the light Q is equal to or less than the preset amount of received light Qr, the photo sensor 200 may be determined to be contaminated. Therefore the photo sensor may be cleaned using a cleaning unit 300 (S630).

Once the photo sensor 200 is cleaned, it may again be determined whether the photo sensor 200 is contaminated using the photo sensor 200. That is, light is emitted (S600), and the light Q reflected by the intermediate transfer medium 140 is received (S610) and may be compared to the preset reference amount of received light Qr (S620).

As a result, in this example, when the light Q is greater than the preset reference amount of received light Qr, the photo sensor 200 may be determined as not being contaminated and the method may be completed.

However, here, when the light Q is equal to or less than the preset reference amount of received light Qr, a cleaning process may be performed again (S630).

In FIG. 7, an example of the repeated cleaning process is shown when the photo sensor 200 was determined as being contaminated. However, when a number of times that the photo sensor 200 has been determined to be contaminated is equal to or greater than a preset critical number of times, the cleaning may be stopped and a failure of the image forming apparatus may be informed to the outside, e.g., to the user.

Figure 8:
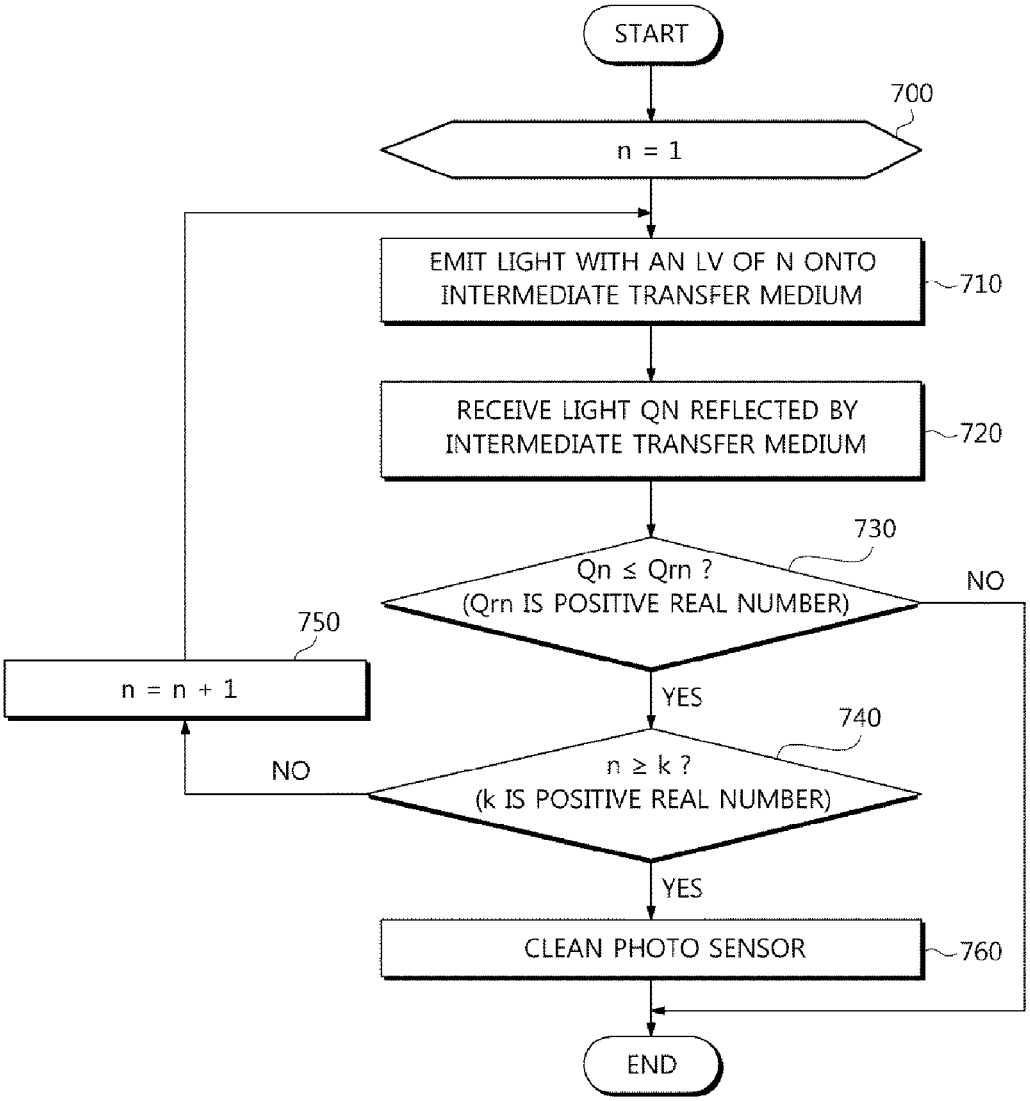
FIG. 8 is a flow chart illustrating an image forming method in accordance with one or more embodiments.

FIG. 8 is a flow chart illustrating an image forming method in accordance with one or more embodiments.

First, an initial value n may be set to 1 (S700).

Next, light with an Lv of n may be emitted onto an intermediate transfer medium 140 using a light emitting portion of a photo sensor 200 (S710). Here, Lv may refer to a level of the amount of the emitted light, and may be proportional to the amount of current input to the light emitting portion of the photo sensor 200.

A photoreceptor of the photo sensor 200 may receive light Qn reflected from the intermediate transfer medium 140 corresponding to the emitted light (S720). Here, Qn may refer to the amount of reflected light based on the value of n.

Next, it is determined whether the amount of the light Qn received by the photoreceptor meets a threshold, e.g., is equal to or less than a reference amount of received light Qrn (S730). In this example, when the light Qn is greater than the reference amount of received light Qrn, the photo sensor 200 may be determined to not be contaminated, and thus the method may be completed without an additional cleaning process.

However, in this example, when the light Qn is equal to or less than the reference amount of received light Qrn, it is determined whether the emitted light with an Lv of n meets a threshold, e.g., is equal to or greater than the a reference amount of emitted light with an Lv of k (S740).

For example, when the light with an Lv of n emitted by the emitting portion is less than the reference amount of emitted light with an Lv of k, a value n is increased by 1 (S750). Subsequently, light with an Lv of n+1 may then be emitted and it may again be determined whether the photo sensor 200 is contaminated.

However, in this example, when the light with an Lv of n emitted from the emitting portion is equal to or greater than the reference amount of emitted light with an Lv of k, it may be determined that the emitting portion is already emitting a maximum amount of light that may be emitted. Therefore, the photo sensor may be cleaned using a cleaning unit 300 without increasing the amount of light.

In FIG. 8, while it was illustrated that the reference amount of received light Qrn was changed according to a value n, e.g., because the received amount of light Qn is based on the value of n the reference amount of received light Qrn may also be dependent on the value of n, the reference amount of received light may be a constant preset Qr even when a value n increases.

Figure 9:
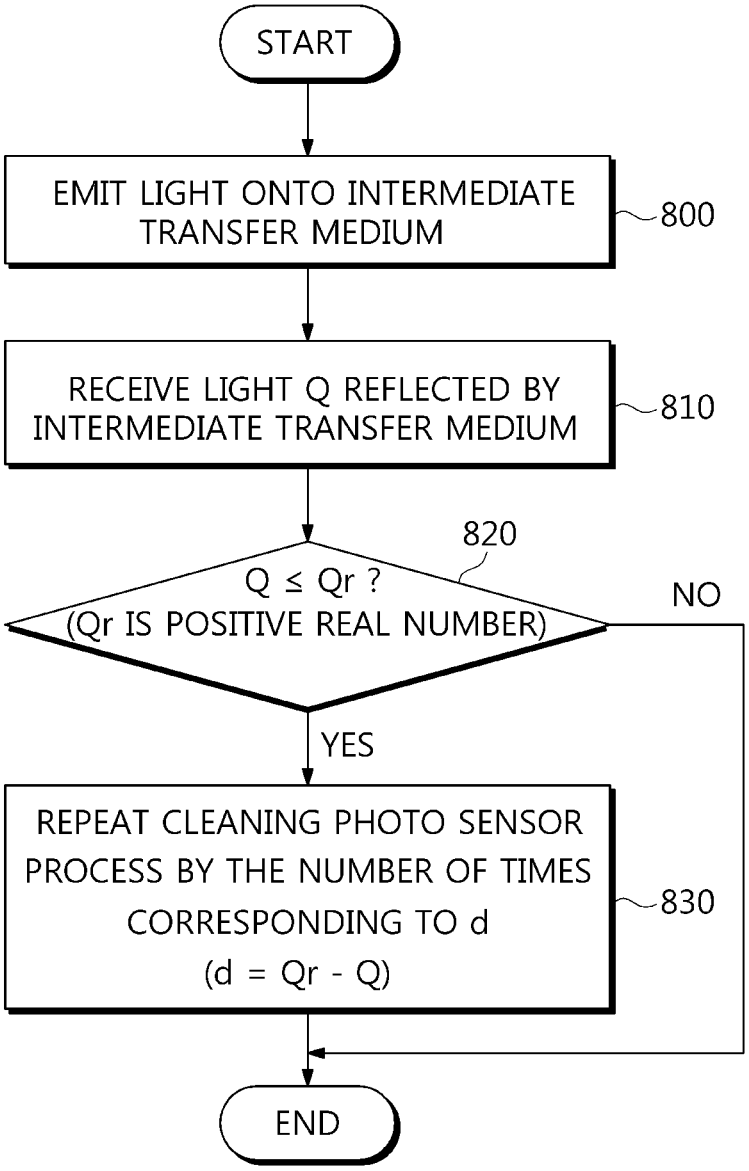
FIG. 9 is a flow chart illustrating an image forming method in accordance with one or more embodiments.

FIG. 9 is a flow chart illustrating an image forming method in accordance with one or more embodiments.

First, light may be emitted onto an intermediate transfer medium 140 using a light emitting portion of a photo sensor (S800).

A photoreceptor of the photo sensor 200 may receive light Q reflected by the intermediate transfer medium 140 corresponding to the emitted light (S810).

The photoreceptor receives the light Q, and it may be determined whether the light Q meets a threshold, e.g., is equal to or less than a preset reference amount of received light Qr (S820). For example, when the light Q is greater than the preset reference amount of received light Qr, the photo sensor 200 may be determined to not be contaminated, and thus the method may be completed without an additional cleaning process.

However, in this example, when the light Q is equal to or less than the preset reference amount of received light Qr, the photo sensor 200 may be determined to be contaminated.

Therefore, the photo sensor 200 may be cleaned using a cleaning unit 300. Specifically, a cleaning process of the photo sensor 200 may be repeated a number of times corresponding to a determined difference d between the preset reference amount of received light Qr and the received light Q (S830).

As the determined contamination level of the photo sensor 200 increases, based on the determined difference d, the number of times the cleaning process is performed may also increase.

Figure 10:
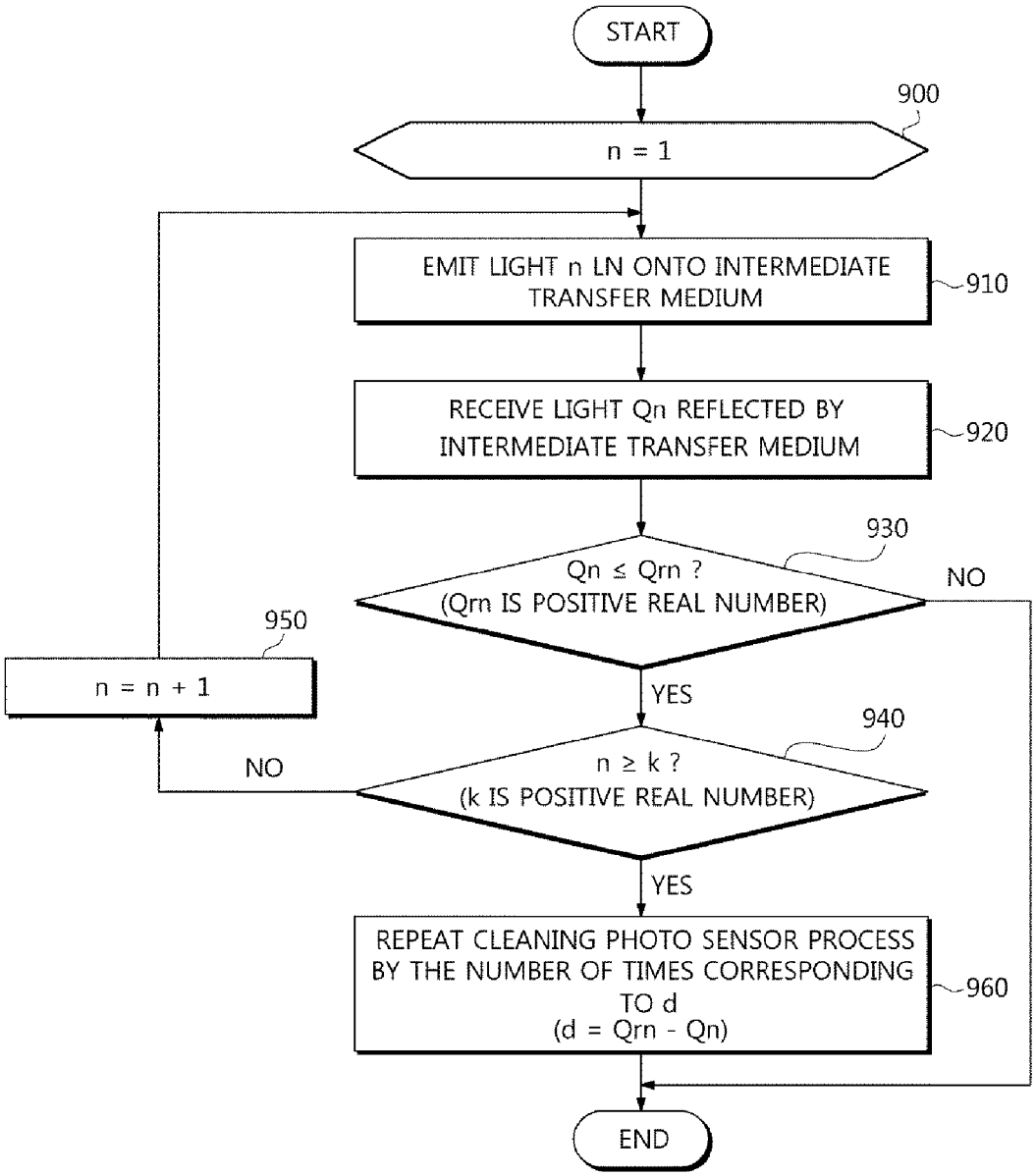
FIG. 10 is a flow chart illustrating an image forming method in accordance with one or more embodiments.

FIG. 10 is a flow chart illustrating an image forming method in accordance with one or more embodiments.

First, an initial value n may be set to 1 (S900).

Next, light with an Lv of n may be emitted onto an intermediate transfer medium 140 using a light emitting portion of a photo sensor 200 (S910).

A photoreceptor of the photo sensor 200 may receive light Qn reflected by the intermediate transfer medium 140 corresponding to the emitted light (S920).

Next, it is determined whether the amount of the light Qn received by the photoreceptor meets a threshold, e.g., is equal to or less than a reference amount of received light Qrn (S930). For example, when the light Qn is greater than the reference amount of received light Qrn, the photo sensor 200 may be determined to not be contaminated, and thus the method may be completed without an additional cleaning process.

However, in this example, when the light Qn is equal to or less than the reference amount of received light Qrn, it is determined whether the emitted light with the Lv of n meets a threshold, e.g., is equal to or greater than a reference amount of emitted light with an Lv of k (S940).

For example, when the light with the Lv of n emitted by the emitting portion is less than the reference amount of emitted light with an Lv of k, the value of n may be increased by 1 (S950). Subsequently, the light with an Lv of n+1 may be emitted and it may again be determined whether the photo sensor 200 is contaminated.

However, in this example, when the light with the Lv of n emitted by the emitting portion is equal to or greater than the reference amount of emitted light with an Lv of k, it may be determined that the emitting portion is already emitting a maximum amount of light that may be emitted.

Therefore, the photo sensor 200 may be cleaned using a cleaning unit 300 without attempting to increase the amount of emitted light. Specifically, the cleaning process of the photo sensor 200 may be repeated a number of times corresponding to a determined difference d between the reference amount of received light Qrn and the received light Q (S960).

As the determined contamination level of the photo sensor 200 increases, based on the determined difference d, the number of times the cleaning process is performed may also increase.

In FIG. 10, while it was illustrated that the reference amount of received light Qrn was changed according to the value n, e.g., because the received amount of light Qn is based on the value of n the reference amount of received light Qrn may also be dependent on the value of n, the reference amount of received light may be a constant preset Qr even when the value n increases.

As is apparent from the above description, an image forming apparatus and method in accordance with one or more embodiments of the present invention may automatically determine whether a photo sensor, such as photo sensor 200, is contaminated and a contamination level thereof and clean the photo sensor and prevent the photo sensor from being contaminated based on that determination. As a result, a photo receiving rate of the photo sensor may increase.

As is apparent from the above description, an image forming apparatus and method in accordance with one or more embodiments of the present invention may not need an additional patch since an intermediate transfer medium is used for determining whether a photo sensor is contaminated and a contamination level thereof.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus, comprising:

an intermediate transfer medium onto which images having different colors are to be overlapped and transferred;

a photo sensor configured to emit light to the intermediate transfer medium and detect received light reflected from the intermediate transfer medium;

a cleaning unit to clean the photo sensor; and a control unit to perform a cleaning operation based on an amount of the received light and an amount of the emitted light, wherein, when the amount of the received light is equal to or less than a reference amount of received light and the amount of the emitted light is equal to or greater than a reference amount of emitted light, based on a current supplied to the photo sensor, the control unit performs the cleaning operation by controlling the cleaning unit to clean the photo sensor.

2. The image forming apparatus according to claim 1, wherein, when the amount of the received light is equal to or less than the reference amount of received light and the amount of emitted light is less than the reference amount of emitted light, the control unit performs the cleaning operation by controlling the photo sensor to emit an increased amount of light onto the intermediate transfer medium and determine whether the photo sensor is contaminated based on the emitted increased amount of light.

3. The image forming apparatus according to claim 1, wherein, in the cleaning operation, the control unit determines a number of times to clean the photo sensor based on a determined difference between the amount of the received light and the reference amount of received light.

4. The image forming apparatus according to claim 3, wherein, in the cleaning operation, the determined number of times to clean the photo sensor is controlled to increase as the determined difference between the amount of the received light and the reference amount of received light increases.

5. The image forming apparatus according to claim 1, wherein, in the cleaning operation, the control unit controls the photo sensor to emit light again and again receive light reflected by the intermediate transfer medium, after the cleaning unit cleans the photo sensor, to determine whether to again clean the photo sensor.

6. The image forming apparatus according to claim 5, further comprising, a display unit which externally indicates a failure of the image forming apparatus when the amount of the received light is equal to or less than the reference amount of received light and a number of repeated light emissions of the photo sensor, performed during the cleaning operation, is equal to or greater than a preset critical number of repeated light emissions.

7. The image forming apparatus according to claim 1, wherein when the amount of the received light is greater than the reference amount of the received light, the control unit controls the intermediate transfer medium to rotate in one direction and performs a color registration operation that senses a change in an amount of light reflected by the rotating intermediate transfer medium.

8. The image forming apparatus according to claim 7, wherein, in the color registration operation, the control unit determines transfer positions of images having different colors on the intermediate transfer medium based on the sensed change in the amount of light.

9. The image forming apparatus according to claim 1, wherein the cleaning unit includes a shutter which unblocks or blocks the light emitted by the photo sensor, and a cleaner provided on one surface of the shutter to be contactable with the photo sensor to perform the cleaning of the photo sensor.

10. The image forming apparatus according to claim 9, wherein the cleaner is spaced apart from the photo sensor when the shutter unblocks the light, and is in contact with the photo sensor when the shutter blocks part or all of light.

11. The image forming apparatus according to claim 1, further comprising a containment container, collocated with the photo sensor, that accommodates a contaminant removed by the cleaning unit.

12. The image forming apparatus according to claim 11, wherein the contaminant container includes an opening portion facing the cleaning unit.

13. An image forming method, comprising:

emitting light onto an intermediate transfer medium using a photo sensor;

receiving light reflected by the intermediate transfer medium using the photo sensor; and when an amount of received light is equal to or less than a reference amount of received light and an amount of emitted light is equal to or greater than a reference amount of emitted light, based on a current supplied to the photo sensor, cleaning the photo sensor.

14. The method according to claim 13, wherein the cleaning of the photo sensor further comprises, when the amount of the received light is equal to or less than the reference amount of received light and the amount of emitted light is less than the reference amount of emitted light, emitting an increased amount of light onto the intermediate transfer medium and determining whether the photo sensor is contaminated based on the emitted increased amount of light.

15. The method according to claim 13, wherein the cleaning of the photo sensor comprises determining a number of times to clean the photo sensor based on a determined difference between the amount of the received light and the reference amount of received light.

16. The method according to claim 15, wherein, in the determining of the number of times to clean the photo sensor, the determined number of times to clean the photo sensor is controlled to increase as the determined difference between the amount of the received light and the reference amount of received light increases.

17. The method according to claim 13, further comprising emitting light again and again receiving light reflected by the intermediate transfer medium, automatically after cleaning the photo sensor, to determine whether to again clean the photo sensor.

18. The method according to claim 17, further comprising externally indicating a failure of an image forming apparatus when the amount of received light is equal to or less than the reference amount of the received light, and a number of repeated light emissions of the photo sensor, corresponding to the determining of whether to again clean the photo sensor, is determined to be equal to or greater than a preset critical number of repeated light emissions.

19. The method according to claim 13, further comprising:

rotating the intermediate transfer medium in one direction when the amount of the received light is greater than the reference amount of the received light, and performing a color registration operation by sensing a change in an amount of light reflected by the rotating intermediate transfer medium.

20. The method according to claim 19, wherein the color registration operation further comprises determining transfer positions of images having different colors on the intermediate transfer medium based on the sensed change in the amount of the light reflected by the rotating intermediate transfer medium.

21. The method according to claim 20, further comprising transferring plural toner images onto the intermediate transfer medium, based on the color registration operation, and transferring the plural toner images from the intermediate transfer medium to paper.

* * * * *